US007040000B2

(12) United States Patent
Takeda

(10) Patent No.: US 7,040,000 B2
(45) Date of Patent: May 9, 2006

(54) METHOD FOR MANUFACTURING A GOLF CLUB HEAD

(75) Inventor: Hitoshi Takeda, Niigata-ken (JP)

(73) Assignee: K.K. Endo Seisakusho, (JP)

( * ) Notice: Subject to any disclaimer, the term of this patent is extended or adjusted under 35 U.S.C. 154(b) by 214 days.

(21) Appl. No.: 10/836,531

(22) Filed: Apr. 30, 2004

(65) Prior Publication Data

US 2004/0219993 A1 Nov. 4, 2004

(30) Foreign Application Priority Data

Apr. 30, 2003 (JP) ..... 2003-125961

(51) Int. Cl.
*A63B 53/02* (2006.01)

(52) U.S. Cl. ..... 29/505; 29/524; 29/521; 72/360; 473/291; 473/292; 473/305

(58) Field of Classification Search ..... 29/505, 29/521, 524; 72/360; 473/291, 292, 305
See application file for complete search history.

(56) References Cited

U.S. PATENT DOCUMENTS 3,825,991 A * 7/1974 Cornell ..... 29/412
4,951,949 A * 8/1990 Kastenhuber ..... 473/313
5,344,140 A * 9/1994 Anderson ..... 473/342
5,575,473 A * 11/1996 Turner ..... 473/298
5,586,949 A * 12/1996 Aizawa ..... 473/345
5,769,307 A * 6/1998 Takeda ..... 228/112.1
5,885,170 A * 3/1999 Takeda ..... 473/306
6,099,414 A * 8/2000 Kusano et al. ..... 473/342

FOREIGN PATENT DOCUMENTS

JP 10-192459 7/1998
JP 11-070191 3/1999
JP 2000-126342 5/2000

* cited by examiner

*Primary Examiner*—Marc Jimenez
*Assistant Examiner*—Christopher Agrawal
(74) *Attorney, Agent, or Firm*—Akerman Senterfitt

(57) ABSTRACT

A method for manufacturing a golf club head with a disparate metallic material provided on a hosel side of the head, which can improve degree of freedom in the design of a head. A head body is made up of a columnar material body 13 made from a forgeable metallic material such as copper and a disparate metallic member 12 as an axial member. The disparate metallic member 12 has its proximal end 12A inserted into a bore 14 formed along a center of axis of the material body 13, while its distal end 12B protruded in the axial direction X. The material body 13 is placed on a lower die 22 which is formed with a mold 21 defining a contour of the head body 11, and then an upper die is pressed thereto. Thus, hot forging process is carried out to form a golf club head.

6 Claims, 4 Drawing Sheets

METHOD FOR MANUFACTURING A GOLF CLUB HEAD

BACKGROUND OF THE INVENTION

1. Field of the Invention

The present invention relates to a method for manufacturing a golf club head.

2. Description of the Related Art

As a conventional technique, Japanese Un-Examined Patent Publication No. 2000-126342 discloses a method for manufacturing a golf club head, the golf club being made up of two pieces, i.e., a head body and a hosel, comprising the steps of: forming the head body and the hosel from suitable metallic materials such as steel product, titanium, titanium alloy, beryllium copper alloy or the like, using press working, forging, casting, machining, or any other suitable method; and joining the thus formed head body and hosel to each other, by laser welding, electronic beam joining, or amorphous joining.

According to the conventional method, the head in a two-piece structure is manufactured by joining the head body to the hosel. There has been a limit, however, to lessening the number of steps in the manufacture thereof.

One of solutions for the problem is disclosed in Japanese Patent Registered Publication No. 3059397, teaching a method for manufacturing a golf club head comprising the steps of: forming a golf club head body from a forgeable metallic material of small specific gravity; providing a composite material member to a placing position locating inside the head body, the composite material member having large specific gravity compared to the head body and high melting point compared to the forging temperature of the forgeable material of the head body; and forming the head body by forging so as to confine the composite material member in the head body.

Moreover, Japanese Patent Registered Publication No. 3140991 discloses a method for manufacturing a golf club head joining a disparate metallic member to a head body. This method comprises: forming at least one opening or one concave portion on a head body member prior to shaping the head body; placing the disparate metallic member in the opening(s) or concave portion(s); then joining the head body member and the disparate metallic members together while forming the head body in a desired shape.

In the former method of the above-mentioned conventional methods, a technique such as combining the head body of relatively small specific gravity and the composite material member of relatively large specific gravity is only available for lowering the C.G. of the head or enlarging the depth of the head (a distance between the center of the gravity of the head and a face) by placing the composite material member adjacent to the sole of the head, and thus the degree of freedom of designing the head would be limited. Moreover, as described above, the composite material member having larger specific gravity than that of the head body and higher melting point than the forging temperature of the head body is provided on a certain placing position inside the head body according to the former conventional method. This would result in a problem that the head body would crack up when the temperature of the inside of the head body does not reach the forging temperature, while it would be overheated when the temperature of the inside of the head body reaches the forging temperature. In order to prevent the head body from cracking, the composite material member needs to be placed on a portion of the head body where an amount of the deformation due to forging is less. Accordingly, the degree of freedom of designing the head is further limited.

On the other hand, according to the latter conventional method, the opening(s) or concave portion(s) is formed on the head body member before shaping the head body. Accordingly, the whole metallic material for forming the head body member is not utilizable, and thus there is a limitation in the reduction of the manufacturing cost.

SUMMARY OF THE INVENTION

The present invention has been made to solve the above problems. It is accordingly an object of the present invention to provide a method for manufacturing a golf club head which can improve the degree of freedom of designing a head, particularly around a hosel thereof.

In order to attain the above object according to a first aspect of the present invention, there is provided a method for manufacturing a golf club head comprising: subjecting a metallic material to a hot forging, using a die so as to form a golf club head prototype having a hosel on one side of a face; and then subjecting a thus formed prototype to a finishing process, wherein the metallic material is composed of: a material body made from a forgeable material; and a disparate metallic member provided integrally with the material body so as to protrude therefrom, the disparate metallic member having smaller specific gravity and different composition than the material body, and wherein the metallic material is subjected to hot forging with the material body being disposed in a face corresponding portion in the above-mentioned die, and the disparate metallic member being disposed in a hosel corresponding portion in the die.

With the structure, the material body can be formed into a face of a club head, while the lighter disparate metallic member, which is integral with the material body, can be formed into a hosel simultaneously.

According to a second aspect of the present invention, there is provided a method for manufacturing a golf club head comprising: subjecting a metallic material to a hot forging, using a die so as to form a golf club head prototype having a hosel on one side of a face corresponding portion; and then subjecting a thus formed prototype to a finishing process, wherein the metallic material is composed of: a material body made from a forgeable material, the material body having a bore; and a disparate metallic member provided inside the bore, the disparate metallic member having smaller specific gravity and different composition than the material body, and wherein the metallic material is subjected to hot forging with the material body being disposed in a face corresponding portion and a hosel corresponding portion in the above-mentioned die, while the disparate metallic member being disposed in a substantially intermediate portion between the face corresponding portion and the hosel corresponding portion in the die.

Thus, the material body can be formed into a face and hosel of a club head, while the lighter disparate metallic member, which is integral with the material body, can be formed into a portion below the hosel simultaneously.

According to a third aspect of the present invention, there is provided a method for manufacturing a golf club head as set forth in the foregoing aspects, wherein the material body is an axial member, while the disparate metallic member is inserted thereinto.

Thus, a gold club head can be formed by subjecting the material body with the disparate metallic member inserted thereinside to a forging process.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENT

A preferred embodiment of the present invention will now be described in detail with reference to the accompanying drawings.

Figure 1:
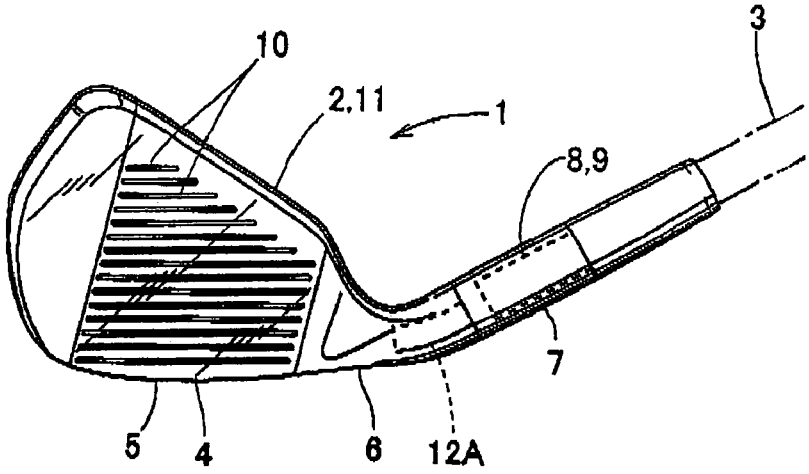
FIG. 1 is a perspective view showing a structure of a golf club head according to a first embodiment of the present invention.
Figure 2:
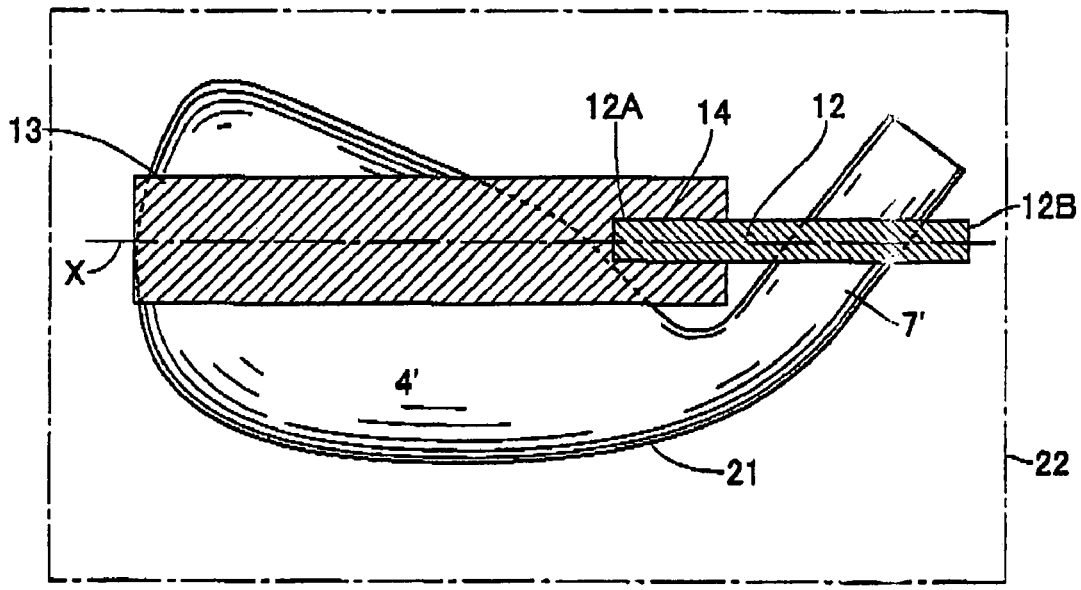
FIG. 2 is a partly cross-sectional plan view for explaining a method for manufacturing a golf club head according to the first embodiment of the present invention.
Figure 3:
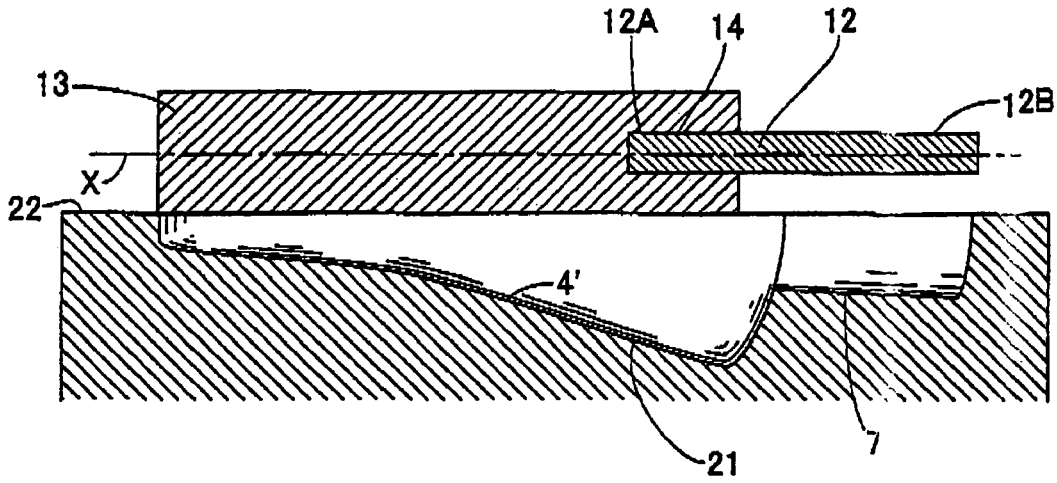
FIG. 3 is a sectional view for explaining the method for manufacturing a golf club head according to the first embodiment.
Figure 4:
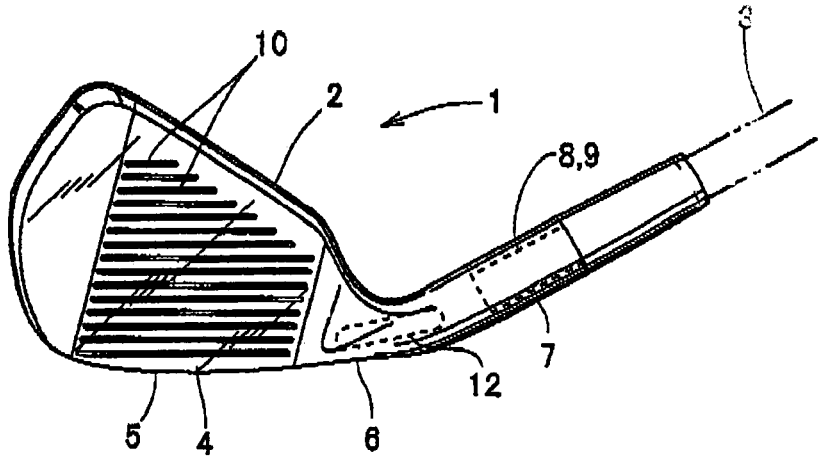
FIG. 4 is a perspective view showing a golf club head according to a second embodiment of the present invention.
Figure 5:
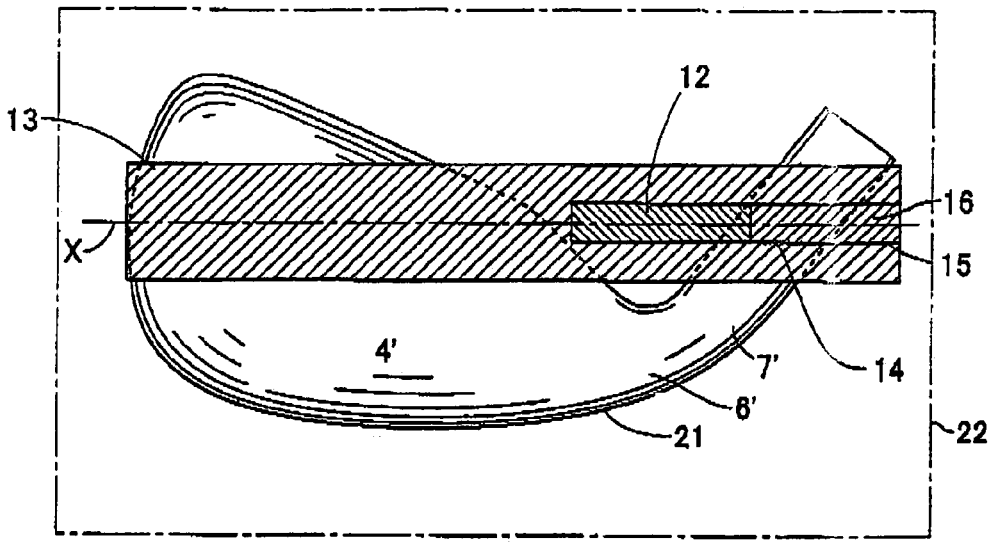
FIG. 5 is a partly cross-sectional plan view showing the method for manufacturing a golf club head according to the second embodiment.
Figure 6:
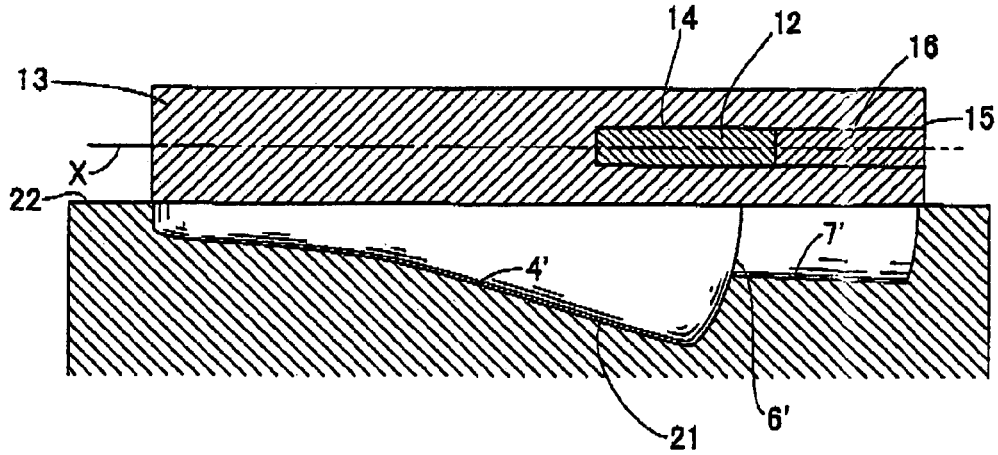
FIG. 6 is a cross-sectional view showing the method for manufacturing a golf club head according to the second embodiment.
Figure 7:
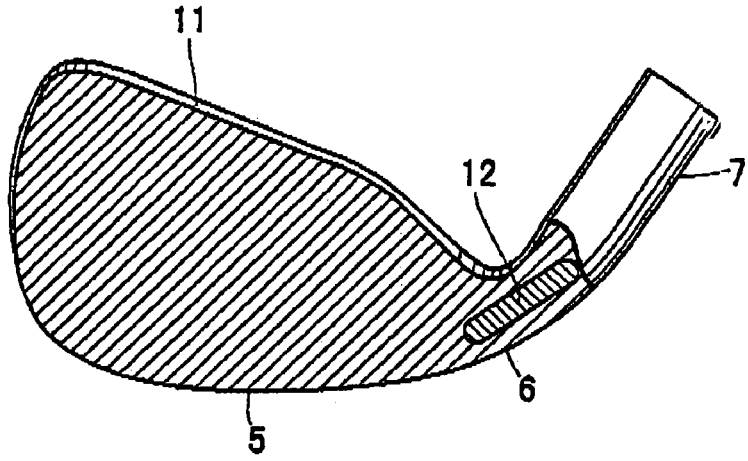
FIG. 7 is a sectional front view for explaining the method for manufacturing a golf club head according to the second embodiment.
Figure 8:
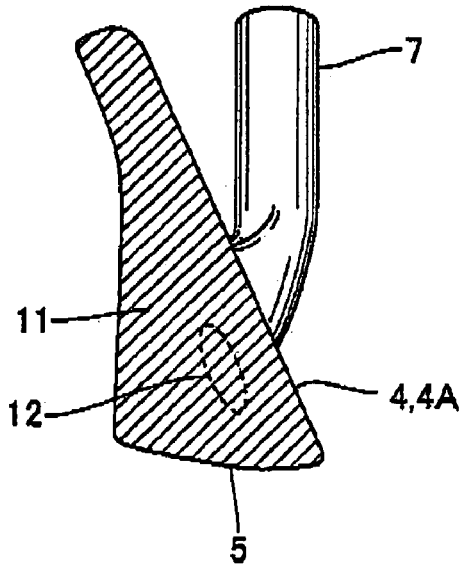
FIG. 8 is a sectional side view for explaining the method for manufacturing a golf club head according to the second embodiment.

A first embodiment will now be described with reference to FIGS. 1 to 3. As shown in FIG. 1, an iron type golf club head 1 comprises: a head 2; and a shaft 3 connected to the head 2. The head 2 has a face serving as a striking surface on its front surface, while it has a sole 5 on its bottom surface as a ground plane. Further, the head 2 has a heel 6 on one side surface thereof, while it has a hosel 7 above the heel 6 as a connecting member of the shaft 3 so that the hosel 7 is arranged to extend obliquely upward. The hosel 7 has a bore 8, while one end 9 of the shaft 3 is connected to the bore 8. Meanwhile, a plurality of grooves 10 as so-called score lines are formed on the face 4 laterally.

The head 2 comprises: a head body 11 made from a forgeable (malleable) metal with strength to withstand hits by a golf ball; and a hosel 7. The forgeable metal is, for example, steel (SUS304 or S20C). The face 4, sole 5 and heel 6 are formed on the head body 11, while the hosel 7 is made from a disparate forgeable metallic member having smaller specific gravity than the head 2, such as pure titanium or titanium alloy, Next, a method for manufacturing the head 2 will now be described. The metallic materials for forming the head body 11 are: a material body 13 having strength to withstand hits by balls, comprising the forgeable metal such as the above-described steel of a columnar shape; and a disparate metallic axial member 12 provided inside a bore 14 formed in the material body 13 along the axial direction X of the material body 13. The disparate metallic member 12 has its proximal end 12A inserted in the bore 14 while its distal end 12B protruded toward the axial direction X.

Then, the material body 13 with the proximal end 12A of the disparate metallic member 12 inserted inside the bore 14 is placed on a lower die 22 having a mold 21 for forming the material body 13 in a shape of the head body 11. Meanwhile, before the material body 13 is placed on the lower die 22, it is pre-heated at its hot forging temperature by a furnace or the like. To form the face 4 in the mold 21, the material body 13 is placed in a face corresponding portion 4' formed concave so as to substantially correspond to a shape of the face 4. On the other hand, to form the hosel 7 in the mold 21, the disparate metallic member 12 is placed in a hosel corresponding portion 7' formed concave so as to substantially correspond to a shape of the hosel 7. With the material body 13 heated to a predetermined temperature being placed in the lower die 22, an upper die (not shown) is pressed to carry out a forging process, so that the head body 11 can be formed by the above-mentioned face corresponding portion 4'. At that moment, the distal end 12B of the disparate metallic member 12 is formed into the hosel 7 by the hosel corresponding portion 7, while the proximal end 12A inserted in the bore 14 is put in a state that it is pressingly inserted toward the heel 6 side in the head body 11. The head body 11 thus formed by hot forging is subjected to finish processing, such as the finish processing of the face 4, the formation of lateral grooves 10 called score lines, and/or surface polishing.

As described above, according to the first embodiment of the present invention, the iron type head body 11 comprises: the material body 13 made from the forgeable metal; and the disparate metallic member 12 provided inside the material body 13 and having small specific gravity compared to the material body 13, and the material body 13 with the disparate metallic member 12 provided thereinside is subjected to hot forging. Thus, the material body 13 is formed into the head body 11 by the face corresponding portion 4', while the disparate metallic member 12 is formed into the hosel 7 by the hosel corresponding portion 7', whereby both the material body 13 made from the forgeable metallic material and the hosel 7 made from the forgeable disparate metallic member 12 can be formed integrally and simultaneously, while reducing the weight of the hosel 7. Accordingly, owing to the reduction of weight of the hosel 7 associated with the employment of the lighter disparate metallic member 12, the weight adjustment of the head 2 can be carried out freely.

Next, a second embodiment of the Invention will be described, in which the same portions as those described In the first embodiment will be designated by the same reference numerals, and their repeated detailed description will be omitted.

The head 2 comprises: a head body 11A made from a forgeable (malleable) metal with strength to withstand hits by a golf ball; and the disparate metallic member 12. The forgeable metal is, for example, steel (SUS304 or S20C). The face 4, sole 5 and hosel 7 are formed on the head body 11, while the disparate metallic member 12 is provided inside a portion below the hosel 7, i.e., on the heel 6 side of the face 4. The disparate metallic member 12 is made from a material having smaller specific gravity than the head body 11, and lower melting point than the hereinafter described forging temperature of the material of the material body 13, such as aluminum or aluminum alloy.

Next, a method for manufacturing the head 2 will now be described. As above mentioned, the metallic materials for forming the head body 11 are the material body 13 having strength to withstand hits by balls, comprising the forgeable metal such as the above-described steel of a columnar shape; and the disparate metallic member 12 provided inside the bore 14 defined in the material body 13 along the axial direction X thereof. After inserting the disparate metallic member 12 into the bore 14, the opening 15 of the bore 14 is closed by a plugging body 16, using suitable fixing means such as welding, said plugging body 16 having the identical composition or the same main composition as the material body 13.

Then, the material body 13 with the disparate metallic member 12 being inserted in the bore 14 is placed on the lower die 22 having the mold 21 for forming the contour of the head body 11, while the disparate metallic material 12 is disposed so as to correspond to the heel corresponding portion 6' in the mold 21. At this moment, the material body 13 with the disparate metallic material 12 inserted in the bore 14 is pre-heated up to its (S20C steel's) hot forging temperature by furnace or the like. Accordingly, the disparate metallic material 12 made from aluminum or aluminum alloy is in a molten state. To form the face 4 in the mold 21, the material body 13 is placed in the face corresponding portion 4' formed concave so as to substantially correspond to the shape of the face 4, while to form the hosel 7 in the mold 21, the material body 13 is placed in the hosel corresponding portion 7' formed concave so as to substantially correspond to the shape of the hosel 7. It should be noted that the disparate metallic member 12 provided inside the material body 13 is located in the heel corresponding portion 6' formed concave With the material body 13 heated up to a predetermined temperature being placed in the lower die 22, forging is carried out by pressing the upper die (not shown) thereto to thereby carry out forging process. Thus, the face 4, heel 6 and the hosel 7 of the head 11 can be formed by the face corresponding portion 4', the heel corresponding portion 6' and the hosel corresponding portion 7', respectively. At that moment, the disparate metallic member 12 is integrally provided inside the material body 13 in a portion below the hosel 7 or on the heel 6 side. The head body 11 thus formed by hot forging is subjected to finish processing, such as the finish processing of the face 4, the formation of lateral grooves 10 called score lines, surface polishing and/or the forming of the bore 8 through the hosel 7.

As described above, according to the second embodiment of the present invention, the iron head body 11 is composed of the material body 13 made from a forgeable metallic material, and the disparate metallic member 12 confined inside the material body 13, said disparate metallic member 12 having smaller specific gravity than the material body 13, whereby the disparate metallic member 12 is provided in an upper portion of the head body 11 other than the sole 5 portion thereof, and thus the head 2 can be lightened. Specifically, as the disparate metallic member 12 is provided in a portion adjacent to the heel 6, the weight of the heel 6 portion can be reduced, so that the weight thus reduced can be distributed toward the face 4, whereby the weight adjustment of the head 2 can be carried out comparatively freely.

In addition, the disparate metallic material 12 provided thereinside is made from a material whose melting point is lower than the forging temperature of the material of the aforesaid material body 13, which makes it possible to prevent the cracking when the inside of the head body 11 does not reach the forging temperature, and to prevent the head body 11 from being overheated when the inside thereof reaches the forging temperature. Accordingly, the degree of freedom of designing the head 2 is not limited.

Various embodiments and changes may be made thereonto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention within the claims are to be regarded to be in the scope of the present invention.

What is claimed is:

1. A method for manufacturing a golf club head, comprising the steps of:

subjecting a metallic material to a hot forging, using a die so as to form a golf club head prototype having a hosel on one side of a face; and then subjecting a thus formed prototype to a finishing process, wherein said metallic material is composed of: a material body made from a forgeable material; and a disparate metal material provided integrally with said material body so as to protrude therefrom, said disparate metallic member having smaller specific gravity and different composition than said material body, and wherein said metallic material is subjected to hot forging with said material body being disposed in a face corresponding portion in said die, and said disparate metallic member being disposed in a hosel corresponding portion in said die.

2. A method for manufacturing a golf club head, comprising the steps of:

subjecting a metallic material to a hot forging, using a die so as to form a golf club head prototype having a hosel on one side of a face corresponding portion; and then subjecting a thus formed prototype to a finishing process, wherein said metallic material is composed of: a material body made from a forgeable material, said material body having a bore; and a disparate metallic member provided inside said bore, said disparate metallic member having smaller specific gravity and different composition than said material body, and wherein said metallic material is subjected to hot forging with said material body being disposed in a face corresponding portion and a hosel corresponding portion in said die, and said disparate material being disposed in a substantially intermediate portion between said face corresponding portion and said hosel corresponding portion.

3. A method for manufacturing a golf club head according to claim 1, wherein said material body is an axial member, while said disparate metallic member is inserted thereinto.

4. A method for manufacturing a golf club head according to claim 2, wherein said material body is an axial member, while said disparate metallic member is inserted thereinto.

5. A method for manufacturing a golf club head according to claim 1, wherein said forgeable material for the material body is SUS304 or S20C while that for said disparate metallic material is pure titanium or titanium alloy.

6. A method for manufacturing a golf club head according to claim 2, wherein said forgeable material for the metallic material is SUS304 or S20C while that for said disparate metallic material is aluminum or aluminum alloy.

* * * * *